US008800660B2

(12) United States Patent
Fishbeck et al.

(10) Patent No.: US 8,800,660 B2
(45) Date of Patent: Aug. 12, 2014

(54) DEBRIS CATCHER FOR COLLECTING WELL DEBRIS

(75) Inventors: Craig Fishbeck, Conroe, TX (US); John C. Wolf, Houston, TX (US)

(73) Assignee: Smith International, Inc., Houston, TX (US)

( * ) Notice: Subject to any disclaimer, the term of this patent is extended or adjusted under 35 U.S.C. 154(b) by 600 days.

(21) Appl. No.: 12/412,084

(22) Filed: Mar. 26, 2009

(65) Prior Publication Data

US 2010/0243258 A1 Sep. 30, 2010

(51) Int. Cl.
*E21B 37/00* (2006.01)
*E21B 31/08* (2006.01)

(52) U.S. Cl.
USPC ..... 166/312; 166/311; 166/99

(58) Field of Classification Search
USPC ..... 166/55.1, 55.6, 99, 107, 170, 173, 298, 166/311, 312, 376; 417/478; 210/242.3; 294/86.11
See application file for complete search history.

(56) References Cited

U.S. PATENT DOCUMENTS

| | | | | | |
|---|---|---|---|---|---|
| 2,556,849 | A * | 6/1951 | Nolley et al. | 166/66.5 |
| 2,700,567 | A * | 1/1955 | Fortenberry | 294/65.5 |
| 3,089,724 | A * | 5/1963 | Crooks | 294/65.5 |
| 3,637,033 | A * | 1/1972 | Mayall | 175/320 |
| 3,653,512 | A * | 4/1972 | Brown | 210/130 |
| 3,841,489 | A * | 10/1974 | Combest et al. | 210/223 |
| 4,067,810 | A * | 1/1978 | Sullivan | 210/223 |
| 5,024,271 | A * | 6/1991 | Meihua | 166/66.5 |
| 5,176,208 | A * | 1/1993 | Lalande et al. | 166/99 |
| 6,176,311 | B1 * | 1/2001 | Ryan | 166/99 |
| 6,216,787 | B1 * | 4/2001 | Ruttley | 166/311 |
| 6,276,452 | B1 * | 8/2001 | Davis et al. | 166/298 |
| 6,655,462 | B1 * | 12/2003 | Carmichael et al. | 166/311 |
| 7,137,449 | B2 * | 11/2006 | Silguero | 166/301 |
| 7,219,724 | B2 * | 5/2007 | Theriot, Sr. | 166/66.5 |

(Continued)

FOREIGN PATENT DOCUMENTS

WO 2009120957 A2 10/2009

OTHER PUBLICATIONS

Dictionary definition of "divert", accessed Mar. 1, 2013 via www.thefreedictionary.com.*

(Continued)

*Primary Examiner* — Blake Michener
(74) *Attorney, Agent, or Firm* — Osha Liang LLP

(57) ABSTRACT

A downhole debris recovery tool including a ported sub coupled to a debris sub, a suction tube disposed in the debris sub, at least one magnet disposed in the debris removal tool, and an annular jet pump sub disposed in the ported sub and fluidly connected to the suction tube. A method of removing debris from a wellbore including the steps of lowering a downhole debris removal tool into the wellbore, flowing a fluid through a bore of an annular jet pump sub, jetting the fluid from the annular jet pump sub into a mixing tube, displacing an initially static fluid in the mixing tube through a diffuser, thereby creating a vacuum effect in a suction tube to draw a debris-laden fluid into the tool, flowing the debris-laden fluid past at least one magnet disposed in a debris housing, and removing the tool from the wellbore is also disclosed.

22 Claims, 5 Drawing Sheets

(56) References Cited

U.S. PATENT DOCUMENTS

| | | | | |
|---|---|---|---|---|
| 7,472,745 | B2 * | 1/2009 | Lynde et al. | 166/99 |
| 7,513,303 | B2 * | 4/2009 | Hern | 166/173 |
| 7,662,282 | B2 * | 2/2010 | Lee et al. | 210/222 |
| 7,753,124 | B1 * | 7/2010 | Penisson | 166/311 |
| 7,789,154 | B2 * | 9/2010 | Davis | 166/312 |
| 8,336,626 | B2 * | 12/2012 | Hern et al. | 166/311 |
| 2006/0011344 | A1 * | 1/2006 | Lynde et al. | 166/298 |
| 2006/0086507 | A1 * | 4/2006 | Surjaatmadja et al. | 166/312 |
| 2011/0024119 | A1 * | 2/2011 | Wolf et al. | 166/301 |
| 2012/0118571 | A1 * | 5/2012 | Zhou | 166/301 |

OTHER PUBLICATIONS

Dictionary definition of "annular", accessed on Jun. 11, 2013 via thefreedictionary.com.*

Combined Search and Examination Report issued in related British Patent Application No. GB1005076.3; Dated May 14, 2010 (5 pages).

Examination Report issued in corresponding Australian Patent Application No. 2010201076: Dated Mar. 10, 2011 (2 pages).

Examination Report issued in corresponding Australian Patent Application No. 2010201076: Dated May 2011 (2 pages).

* cited by examiner

DEBRIS CATCHER FOR COLLECTING WELL DEBRIS

BACKGROUND OF INVENTION

1. Field of the Invention

Embodiments disclosed here generally relate to a downhole debris retrieval tool for removing debris from a wellbore. Further, embodiments disclosed herein relate to a downhole tool that includes magnets for removing debris from a wellbore.

2. Background Art

A wellbore may be drilled in the earth for various purposes. For example, wellbores may be drilled to extract hydrocarbons, geothermal energy, or water. After a wellbore is drilled, the wellbore is typically lined with casing to preserve the shape of the wellbore and to provide a sealed conduit for fluid transportation.

It is beneficial to keep a wellbore clean because many complications may occur when debris collects therein. For example, accumulation of debris may prevent free movement of tools through the wellbore during operations, interfere with production of hydrocarbons, and/or damage tools. Different types of debris may include cuttings produced from the drilling of a wellbore, metallic debris from various tools and components used in drilling operations, and debris from the corrosion of the wellbore casing. Smaller, lighter debris may be circulated out of the wellbore using drilling fluid; however, drilling fluid may not be capable of returning larger, heavier debris to the surface. In particular, horizontal wells and significantly angled portions of deviated wells may be more likely to collect debris. Because this problem is well known in the art, many tools and methods have been developed to help maintain clean wellbores.

One type of well-known tool for collecting debris is the junk catcher, sometimes referred to as a junk basket, junk boot, or boot basket, depending on the particular configuration and the particular debris to be collected. Although many junk catchers known in the art rely on various mechanisms to capture debris, most use the movement of fluid in the wellbore to transport debris to a desired location. Fluid may be moved within the wellbore by surface pumps or by movement of the string of pipe to which the junk catcher is connected. Hereinafter, the term "work string" will be used to collectively refer to the string of pipe or tubing in addition to all other tools that may be used with the junk catcher. For describing fluid flow, the term "uphole" refers to a direction toward the surface, relative to a location inside the wellbore. Additionally, the term "downhole" refers to a direction extending into the formation from a surface opening of a wellbore, relative to a location inside the wellbore.

Some junk catchers known in the art use a combination of flow diverters and screens to separate debris from drilling fluid, as shown in FIGS. 1A and 1B. Such junk catchers 10 may deposit large or heavy debris into a storage container 12 using a mechanism such as a flow diverter 14. Debris that remains suspended in the drilling fluid may then pass into a second stage of filtration. In some configurations, the second stage may include a chamber fitted with a screen 16 through which drilling fluid flows. Debris suspended in the drilling fluid that is of an allowable size will pass through the screen 16 while debris that is too large will not. In some configurations, debris may become stuck in the screen 16, thus clogging the tool and preventing internal fluid flow and suction.

Accordingly, there exists a need for a junk catcher tool capable of effectively removing debris from a wellbore. Specifically, there exists a need for a junk catcher with a mechanism for preventing clogging of a screen.

SUMMARY OF INVENTION

In one aspect, the embodiments disclosed herein relate to a downhole debris removal tool including a ported sub coupled to a debris sub, a suction tube disposed in the debris sub, at least one magnet disposed in the debris removal tool, and an annular jet pump sub disposed in the ported sub and fluidly connected to the suction tube.

In another aspect, the embodiments disclosed herein relate to a method of removing debris from a wellbore including lowering a downhole debris removal tool into the wellbore, the downhole debris removal tool comprising an annular jet pump sub, a mixing tube, a diffuser, a debris housing, and a suction tube. Additionally, the method includes flowing a fluid through a bore of the annular jet pump sub, jetting the fluid from the annular jet pump sub into the mixing tube, and displacing an initially static fluid in the mixing tube through the diffuser, thereby creating a vacuum effect in the suction tube to draw a debris-laden fluid into the downhole debris removal tool. The method further includes flowing the debris-laden fluid past at least one magnet disposed in the debris housing, and removing the downhole debris removal tool from the wellbore after a predetermined time interval.

Other aspects and advantages of the invention will be apparent from the following description and the appended claims.

DETAILED DESCRIPTION

In one aspect, embodiments disclosed herein generally relate to a downhole tool for removing debris from a wellbore. In particular, embodiments disclosed herein relate to a downhole tool having at least one magnet for collecting debris from a fluid.

Figure 1A:
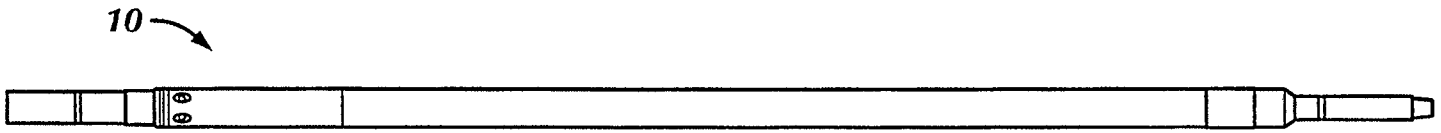
FIG. 1A (Prior Art)
FIGS. 1A and 1B show perspective and cross-sectional views, respectively, of a conventional debris catcher.
Figure 1B:
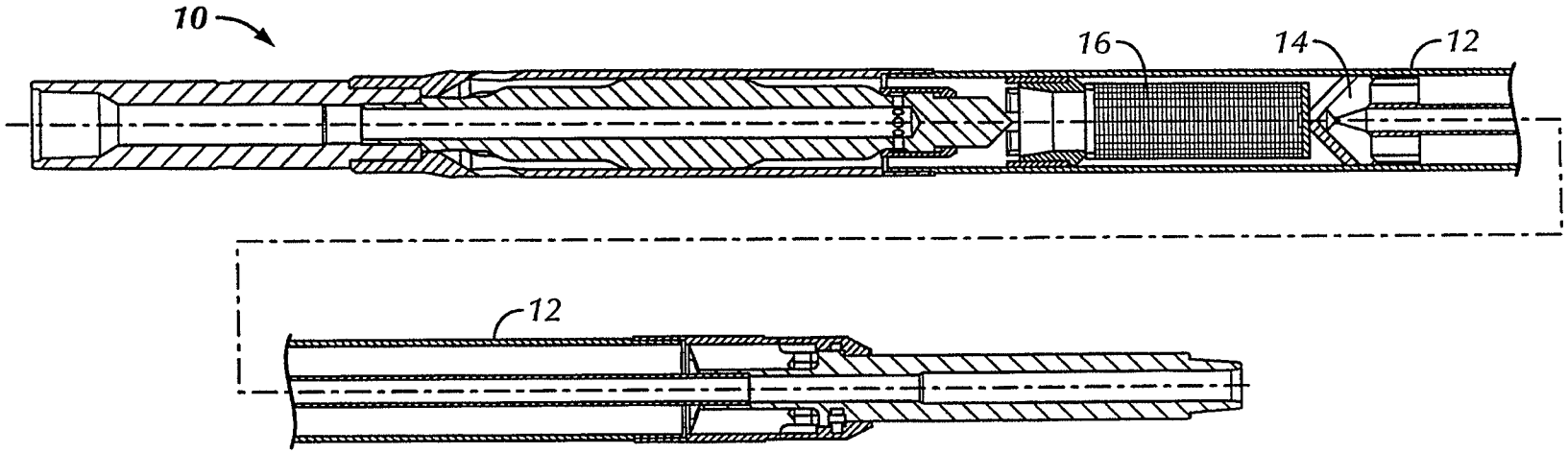
Figure 2:
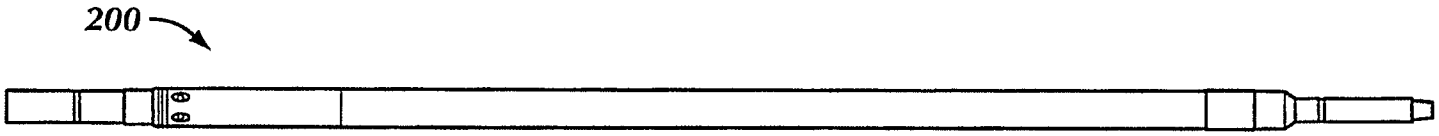
FIG. 2 shows a side view of the debris catcher in accordance with embodiments disclosed herein.
Figure 3A:
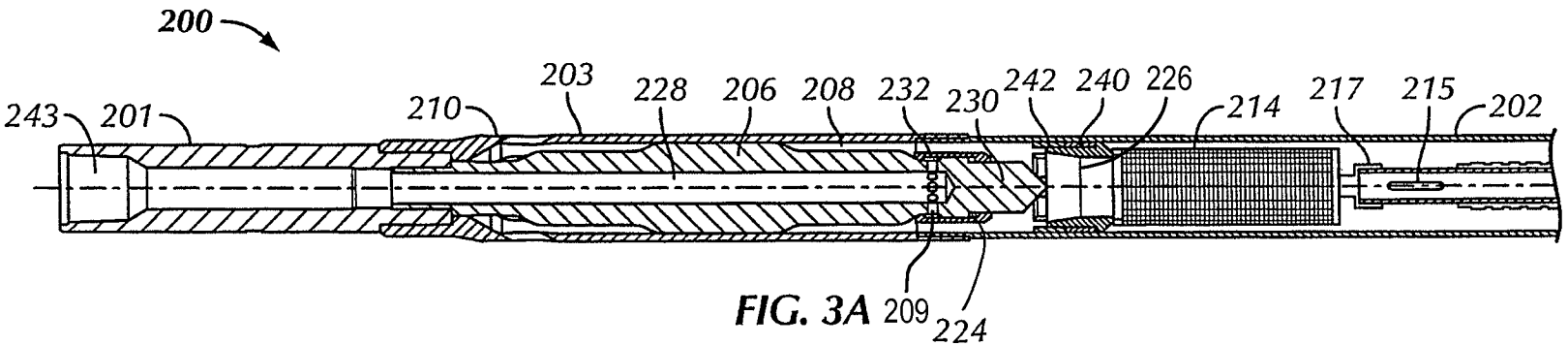
FIGS. 3A and 3B show cross-sectional views of upper and lower portions of a debris catcher in accordance with embodiments disclosed herein.
Figure 3B:
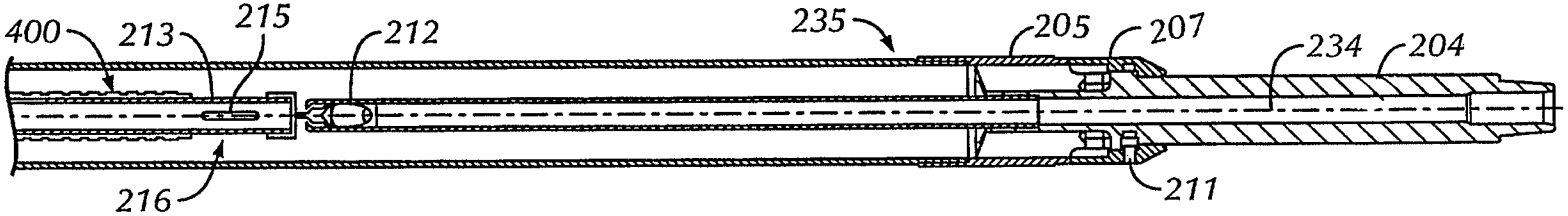
Figure 4:
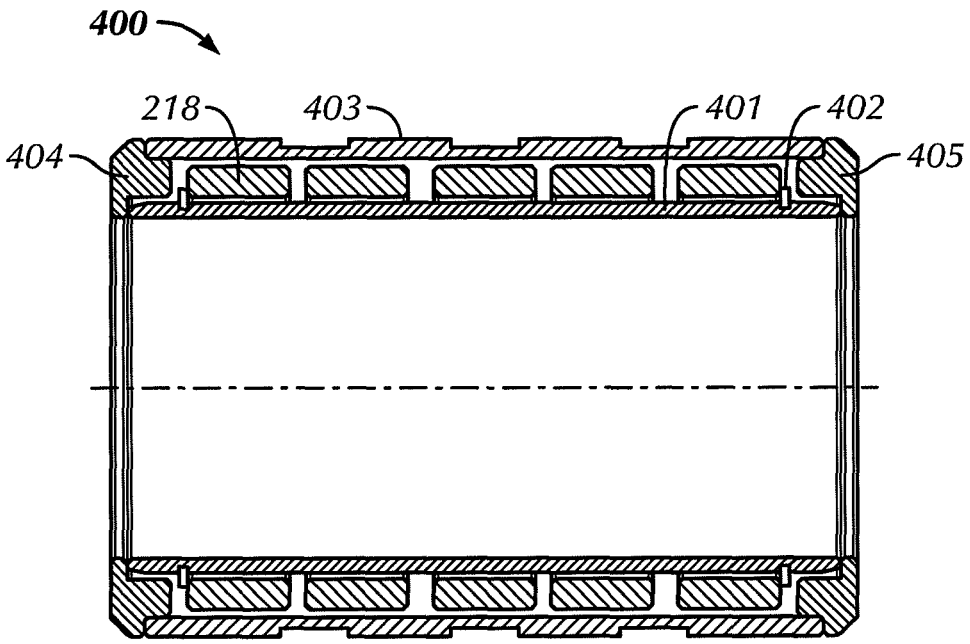
FIG. 4 shows a detailed view of a magnet assembly in accordance with embodiments disclosed herein.
Figure 5:
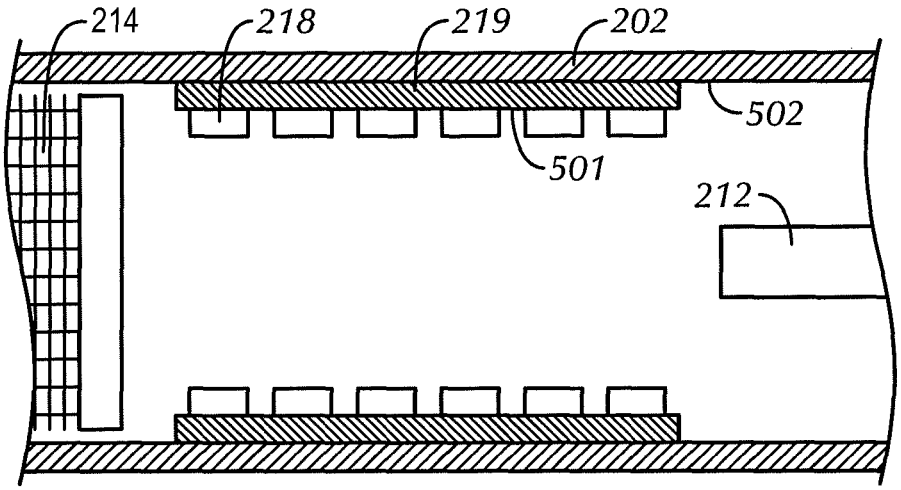
FIG. 5 shows a detailed view of another magnet assembly in accordance with embodiments disclosed herein.

FIGS. 2, 3A and 3B show a downhole debris removal tool in accordance with embodiments of the present disclosure. FIG. 2 shows a side view of the downhole tool. FIGS. 3A and 3B show cross-sectional views of upper and lower portions of the downhole debris removal tool. FIGS. 4 and 5 show detailed cross sectional views of two different magnet assemblies in accordance with embodiments disclosed herein. Referring initially to FIGS. 3A and 3B, downhole debris removal tool 200 includes a top sub 201, a ported sub 203, a debris housing 202, a debris removal cap 207, and a bottom sub 205. The top sub 201 is configured to connect to a drill string and includes a central bore 243 configured to provide a flow of fluid through the downhole debris removal tool 200. A section of washpipe (not shown) may be provided below the downhole debris removal tool 200.

The ported sub 203 is disposed below the top sub 201 and houses a mixing tube 208, a diffuser 210, and an annular jet pump sub 206. The ported sub 203 is a generally cylindrical component and includes a plurality of ports configured to align with the diffuser 210 proximate the upper end of the ported sub 203, thereby allowing fluids to exit the downhole debris removal tool 200. The ported sub 203 may be connected to the top sub 201 by any mechanism known in the art, for example, threaded connection, welding, etc.

Still referring to FIGS. 3A and 3B, the annular jet pump sub 206 is a component disposed within the ported sub 203. The annular jet pump sub 206 includes a bore 228 in fluid connection with the central bore 243 of the top sub 201. At least one small opening or jet 209 fluidly connects the bore 228 of the annular jet pump sub 206 to the mixing tube 208. The jet or jets 209 provide a flow of fluid from the drill string into the mixing tube 208 to displace initially static fluid in the mixing tube 208. In select embodiments, the at least one jet may be a high pressure or low pressure nozzle. The fluid then flows upward in the mixing tube 208 and exits the ported sub 203 through the diffuser 210.

A lower end 230 of the annular jet pump sub 206 is disposed proximate an exit end of a screen 214 disposed on the debris housing 202, forming an inlet 226 into the mixing tube 208. Fluid suctioned up through the debris housing 202 enters the mixing tube 208 through inlet 226 and exits the mixing tube through one or more diffusers 210. An annular jet cup 232 is disposed over the lower end 230 of the annular jet pump sub 206 and is configured to at least partially cover the jet or jets 209 to provide a ring nozzle. The size of the at least one jet 209 may be changed by varying the gap between the annular jet cup 232 and the annular jet pump sub 206, thereby providing for flexible operation of the downhole debris removal tool 200. The gap may be varied by moving the annular jet cup 232 in an uphole or downhole direction along the annular jet pump sub 206. In one embodiment, the annular jet cup 232 may be threadedly coupled to the annular jet pump sub 206, thereby allowing the annular jet cup 232 to be threaded into a position that provides a desired gap between annular jet cup 232 and the annular jet pump sub 206.

A spacer ring 224 may be disposed around the lower end 230 of the annular jet pump sub 206 and proximate a shoulder formed on an outer surface of the lower end 230. The spacer ring 224 is assembled to the annular jet pump sub 206 and the annular jet cup 232 is disposed over the lower end 230 and the spacer ring 224. Thus, the spacer ring 224 limits the movement of the annular jet cup 232. One or more spacer rings 224 with varying thickness may be used to selectively choose the location of the assembled annular jet cup 232, and provide a pre selected gap between the annular jet cup 232 and the annular jet pump sub 206. Varying the gap between the annular jet cup 232 and the annular jet pump sub 206 also provides for adjustment of the distance of the at least one jet 209 from the mixing tube inlet 226. Thus, the jet standoff distance of the tool 200 may be increased, thereby promoting jet pump efficiency.

The debris housing 202 is coupled to a lower end of the ported sub 203 and houses a suction tube 204, a flow diverter 212, a mandrel-type magnet carrier 213, and screen 214. The debris housing 202 may be connected to the ported sub 203 by any mechanism known in the art, for example, threaded connection, welding, etc. The debris housing 202 is configured to separate and collect debris from a fluid stream as the fluid is vacuumed or suctioned up through the downhole debris recovery tool 200. The suction tube 204 is configured to receive a stream of fluid and debris from the wellbore, and to direct the stream through the flow diverter 212. In one embodiment, the flow diverter 212 may be a spiral flow diverter. In this embodiment, the spiral flow diverter is configured to impart rotation to the fluid/debris stream as it enters a debris chamber from the suction tube 204. The rotation imparted to the fluid may help separate the debris from the fluid stream, and the debris may settle in the debris housing 202. A debris removal cap 207 may be coupled to a lower end of the debris housing 202 and may be removed from the downhole debris recovery tool 200. The length of the debris housing 202 may be selected based on the anticipated debris volume in the wellbore.

Debris housing 202 may house mandrel-type magnet carrier 213 having at least one magnet assembly 400 disposed thereon. In the embodiment shown in FIG. 4, magnet assembly 400 includes an inner sleeve 401 disposed around a mandrel-type magnet carrier 213 (FIG. 31) and at least one magnet 218 is disposed around the inner sleeve 401. In the embodiment shown, magnet 218 is ring-shaped, but one of ordinary skill in the art will appreciate that other shapes may be used, for example, magnetic bars, sleeves, etc. In select embodiments, multiple magnet assemblies 400 may be coupled together by any means known in the art. In this embodiment, because the magnet assemblies 400 are rigid, a mandrel-type magnet carrier 213 may not be required to provide structural strength and axial alignment to the magnet assemblies 400. The magnet 218 shown in FIG. 4 are held in place by snap rings 402. An outer sleeve 403 may be disposed around the at least one magnet 218 and held in place by an upper endcap 404 and a lower endcap 405, as shown. Additionally, the outer sleeve 403 may have a smooth or grooved surface. In alternate embodiments, the mandrel-type magnet carrier 213 may be magnets themselves, i.e., magnetized metal.

Referring to FIGS. 3A and 3B, openings 215 may be disposed in the body of the mandrel-type magnet carrier 213 such that fluid may flow in through a lower end 216, along a central bore, and out through an opening 215 disposed proximate an upper end 217 of the mandrel-type magnet carrier 213. In another embodiment, magnets may be circular disks or coin-shaped (not shown) and press-fit onto an outer surface of the mandrel-type magnet carrier 213. In select embodiments, the magnets 218 are rare earth magnets. One of ordinary skill in the art will appreciate that other shapes, sizes, and types of magnets, and other attachment methods known in the art may be used without departing from the scope of the embodiments disclosed herein.

In embodiments having a mandrel-type magnet carrier 213 as shown in FIG. 3B, debris-laden fluid flows around the outside of the mandrel-type magnet carrier 213 and may flow through openings 215 disposed in the mandrel-type magnet carrier 213. The at least one magnet disposed in a magnet assembly 400 on the magnet carrier attracts metallic debris, thereby pulling metallic debris out of the fluid. The fluid continues to flow past the mandrel-type magnet carrier 213 and through the screen 214 with fewer metallic debris particles entrained therein. The reduced metallic debris content in the fluid may decrease the tendency of the screen 214 to become clogged.

Additionally, in some embodiments, the magnet carrier may be a sleeve-type magnet carrier 219, as shown in FIG. 5, having an outer diameter substantially equal to the inner diameter of debris housing 202, and having magnets 218 affixed to an inner surface 501. The sleeve-type magnet carrier 219, including magnets 218, may be disposed above the flow diverter 212 (FIG. 3B) and below the screen 214. In one embodiment, the magnets may be rare earth magnets. One of ordinary skill in the art will appreciate that a variety of shapes, sizes, and types of magnets may be used without departing from the scope of the embodiments disclosed herein. For example, in some embodiments, the magnets 218 may be ring-shaped, while in other embodiments, the magnets may be circular disks or inserts press-fit into the sleeve-type magnet carrier 219. In still other embodiments, the magnets 218 may be coupled or affixed to an inner surface 502 of the debris housing 202.

In the embodiments having a sleeve-type magnet carrier 219, as shown in FIG. 5, or where the magnets 218 are coupled to the inner surface 502 of debris housing 202, debris-laden fluid flows through the center of the sleeve and over the magnets disposed on the inner surface of the sleeve. The magnets attract metallic debris and cause the metallic debris to stick to the magnets or magnet assembly. As discussed above, the magnets help prevent the screen filter from being clogged by metallic debris.

Figure 6:
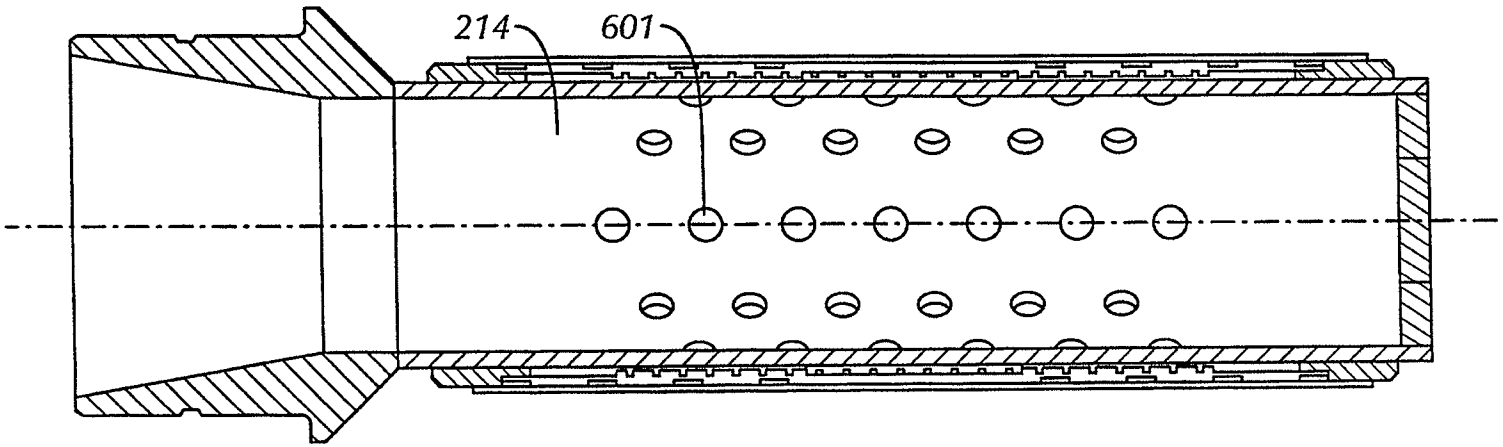
FIG. 6 shows a perspective view of a screen of a downhole debris removal tool in accordance with embodiments disclosed herein.

In one embodiment, the screen 214 may be a cylindrical component with small perforations 601 disposed on an outside surface, as shown in FIG. 6. In alternate embodiments, the outer cylindrical surface of the screen 214 may be formed from a wire mesh cloth, as shown in FIG. 3A. One of ordinary skill in the art will appreciate that any screen known in the art for debris recovery may be used without departing from the scope of embodiments disclosed herein. In certain embodiments, the screen 214 is a low differential pressure screen. A packing element 240 and an element seal ring 242, shown in FIG. 3A, are disposed around a pin end of the screen 214 to prevent fluid from bypassing the screen 214. The fluid stream flowing through the diverter 212, passes over the at least one magnet assembly 400, and enters the screen 214. Debris larger than the perforations or mesh size of the screen cloth remains on the surface of the screen or falls and remains within the debris housing 202. The filtered stream of fluid is then further suctioned up into the ported sub 203.

Figure 7:
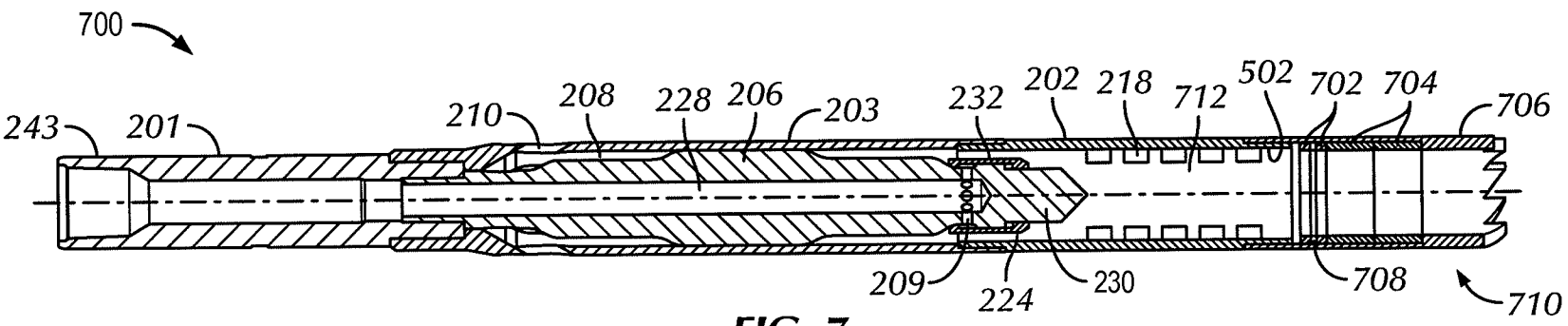
FIG. 7 shows a cross-sectional view of a debris catcher in accordance with embodiments disclosed herein.

In select embodiments, a downhole debris removal tool 700 may be configured for catching large debris. An example of one such configuration is shown in FIG. 7. Similar to other embodiments disclosed herein, FIG. 7 shows a top sub 201, diffuser 210, mixing tube 208, debris housing 202, ported sub 203, annular jet sub 206 disposed in ported sub 203, and annular jet cup 232 disposed on annular jet sub 206, and bore 712 disposed through debris housing 202. The downhole debris removal tool 700 of FIG. 7 also includes at least one debris catcher 704, race ring 702, ball bearing ring 708, and rotary shoe 706 having a lower end 710. Various types of rotary shoes may be used to remove objects that may have become stuck in a wellbore. A tooth-type rotary shoe is shown in FIG. 7, but one of ordinary skill will appreciate that any type of rotary shoe known in the art may be used. Magnets 218 may be disposed on an inner surface 502 of debris housing 202, as shown. In another embodiment, magnets may be disposed on an inner surface of a sleeve-type magnet carrier, similar to that shown in FIG. 5. Alternatively, magnets may be disposed on both an inner surface 502 of debris housing 202 and on a surface of a magnet carrier.

A method of operating the tool 200 of the embodiment shown in FIGS. 3A and 3B may include pumping a fluid down through the central bore 243 of the top sub 201 and into the bore 228 of the annular jet pump sub 206. The fluid exits the annular jet pump sub 206 through at least one jet 209 into the mixing tube 208. Injecting the fluid into the mixing tube 208 displaces the originally static fluid in the mixing tube 208. The jet fluid and the static fluid mix in the mixing tube 208 and exit through the diffuser 210. The fluid exits the diffuser 210 and creates a vacuum effect at the suction tube 204 which dislodges and removes debris from the wellbore.

Suction at the suction tube 204 provided by the annular jet pump sub 206 draws fluid and debris into the downhole debris removal tool 200 up through bore 234. The flow diverter 212 may divert the fluid/debris mix from the suction tube 204 radially outward and downward. The flow diverter 212 may be configured to provide rotation to the fluid stream as it is diverted downwards. The rotation provided to the fluid stream may help separate the debris from the fluid stream due to the centrifugal effect and the greater density of the debris. Thus, the flow diverter 212 separates larger pieces of debris from the fluid. The debris separated from the fluid streams drop downwards within the debris housing 202. Thus, larger pieces of debris may settle into a lower end 235 of debris housing 202.

After the fluid stream exits the diverter, it travels upward past the at least one magnet. Metallic particles and debris entrained in the fluid may be attracted to the magnets, and thus, are removed from the fluid. In some embodiments having a mandrel-type magnet carrier 213, as shown in FIG. 3B, the fluid may also pass through the mandrel-type magnet carrier 213 via openings 215 disposed in upper end portion 217 and lower end portion 216 thereof. In the event that debris accumulates on the at least one magnet or on the at least one magnet assembly 400, blockage of fluid flow by debris on the outside of the mandrel-type magnet carrier 213 may be avoided by using openings 215. The openings 215 may provide access to a central passage or bore through which fluid may flow such that the suction action of the tool may be maintained. After the stream passes over and/or through the mandrel-type magnet carrier 213, it travels through the screen 214. The screen 214 is configured to remove additional debris entrained in the fluid stream.

After passing through the screen 214, the fluid flows through mixing tube inlet 226, past the annular jet pump sub 206, and into the mixing tube 208. The fluid is then returned to the casing annulus (not shown) through the diffuser 210. The fluid entering the mixing tube 208 from the suction tube 204 may not significantly change direction until after the fluid enters the diffuser 210 and is diverted into the casing annulus.

A method of operating the tool 700 of the embodiment shown in FIG. 7 may include pumping fluid down a central bore 243 of top sub 201, and into bore 228 of annular jet pump sub 206. The fluid exits through the at least one jet 209 into mixing tube 208. Injection of the fluid into mixing tube 208 displaces the originally static fluid in mixing tube 208. The jet fluid and the static fluid mix in the mixing tube 208 and exit through the diffuser 210. Fluid exiting the diffuser 210 creates a vacuum effect at the bottom of rotary shoe 706 which dislodges and removes debris from the wellbore.

A lower end 710 of rotary shoe 706 engages a material to be removed. The at least one race ring 702 and ball bearing ring 708 allow rotary shoe 706 to rotate. Suction at the bottom of rotary shoe 706 provided by the annular jet pump sub 206 draws fluid and debris into the downhole debris removal tool 700. The debris catchers 704 collect large pieces of debris created when the rotary shoe 706 engages and removes material. In this embodiment, a flow diverter may not be required to separate large debris from the fluid. Fluid containing smaller debris that was not trapped by debris catchers 704 flows upward through bore 712 and past magnets 218 that may be disposed on an inner surface 502 of debris housing 202, as shown. In another embodiment, the fluid may flow over magnets disposed on an inner surface of a sleeve-type magnet carrier. In yet another embodiment, fluid may flow over a sleeve assembly (not shown) that may house magnets such that the magnets may not be directly exposed to the fluid.

Metallic debris in the fluid may be attracted to the magnets 218 and may stick to the magnets 218 or the sleeve assembly (not shown). The metallic debris pulled out of the fluid by magnets 218 will not circulate through the mixing tube 208 or exit back into the wellbore through diffusers 210. As a result, a debris removal tool in accordance with the embodiments discussed above may provide for a cleaner wellbore.

Upon completion of the debris recovery job, the drill string is pulled from the wellbore and the downhole debris recovery tool 200 is returned to the surface. A retaining screw 211 may be removed from the debris removal cap 207 to allow the debris removal cap 207 to be removed from the downhole debris recovery tool 200, thereby allowing the debris to be easily removed from the debris housing 202.

Advantageously, embodiments disclosed herein provide a downhole debris removal tool that includes a jet pump device to create a vacuum to suction fluid and debris from a wellbore. Further, the downhole debris removal tool of the present disclosure uses magnets to attract and remove metallic debris from a fluid and to prevent the debris from clogging the screen. Additionally, the downhole debris removal tool of the present disclosure may be used in wellbores of varying sizes.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A downhole debris removal tool comprising:

a ported sub having an annular jet pump sub, wherein the annular jet pump sub includes a ring nozzle configured to direct fluid flow into a mixing tube defined between the ported sub and the annular jet pump sub; and a debris housing disposed downhole of the ported sub, the debris housing including:

a suction tube that receives a fluid stream and directs the fluid stream through a flow diverter, a magnet carrier, a screen, and into the mixing tube;

the magnet carrier carrying at least one magnet and axially positioned between the screen and the flow diverter.

2. The downhole debris removal tool of claim 1, further comprising a sleeve disposed around an outer surface of the magnet carrier.

3. The downhole debris removal tool of claim 2, wherein the at least one magnet is disposed on the sleeve disposed around the outer surface of the magnet carrier.

4. The downhole debris removal tool of claim 1, wherein the at least one magnet is disposed on an inner surface of the debris housing.

5. The downhole debris removal tool of claim 1, wherein the at least one magnet is one selected from ring shaped and coin shaped.

6. The downhole debris removal tool of claim 1, wherein the at least one magnet is disposed radially outside of the magnet carrier.

7. The downhole debris removal tool of claim 1, wherein the at least one magnet is disposed radially inside of the magnet carrier.

8. The downhole debris removal tool of claim 1, further comprising at least two openings disposed on an outer surface of the magnet carrier.

9. The downhole debris removal tool of claim 1, wherein the magnet carrier carries five magnets.

10. The downhole debris removal tool of claim 1, wherein the magnet carrier carries one or more magnet assemblies including the at least one magnet.

11. The downhole debris removal tool of claim 10, wherein the one or more magnet assemblies are configured to be coupled together.

12. The downhole debris removal tool of claim 11, wherein at least two magnet assemblies are coupled together.

13. The downhole debris removal tool of claim 1, wherein the magnet carrier comprises a magnetized material.

14. The downhole debris removal tool of claim 1, further comprising a diffuser through which the fluid flow exits the ported sub.

15. The downhole debris removal tool of claim 14, the diffuser and the ring nozzle both being longitudinally offset relative to one another.

16. A method of removing debris from a wellbore comprising:

lowering a downhole debris removal tool into the wellbore, the downhole debris removal tool including:

a ported sub having an annular jet pump sub; and a debris housing disposed downhole of the ported sub, the debris housing including:

a suction tube that receives a first fluid stream and directs the first fluid stream through a flow diverter;

a screen; and a magnet carrier carrying at least one magnet and axially positioned between the screen and the flow diverter;

drawing a debris-laden fluid into the suction tube, through the flow diverter, the flow diverter configured to separate debris from the first fluid stream, and along a length of the magnet carrier such that metallic debris is removed from the fluid by the magnet carrier prior to the fluid passing through the screen and the ported sub; and mixing the debris-laden fluid with a surface supplied fluid within the downhole debris removal tool.

17. The method of claim 16, further comprising removing a debris removal cap from a lower end of the downhole debris removal tool.

18. The method of claim 16, further comprising separating debris from the debris-laden fluid by imparting a rotation to the debris-laden fluid drawn through the flow diverter.

19. The method of claim 16, wherein the drawing the debris-laden fluid along the length of the magnet carrier carrying at least one magnet includes flowing the debris-laden fluid radially outside of the magnet carrier.

20. The method of claim 16, wherein the drawing of the debris-laden fluid along the length of the magnet carrier includes flowing the debris-laden fluid radially inside of the magnet carrier.

21. The method of claim 16, further comprising:

supplying the surface supplied fluid to the ported sub;

directing the surface supplied fluid through the annular jet pump sub into a mixing tube of the ported sub; and displacing the debris laden fluid in the ported sub with the surface supplied fluid.

22. The method of claim 21, further comprising ejecting the mixture of the debris-laden fluid and the surface supplied fluid into an annulus of the wellbore.

* * * * *